United States Patent [19]

Bowers

[11] 4,084,464

[45] Apr. 18, 1978

[54] APPARATUS FOR PREPARING CROSS-LAPPED FILM STRUCTURES

[75] Inventor: John R. Bowers, Bartlesville, Okla.

[73] Assignee: Phillips Petroleum Company, Bartlesville, Okla.

[21] Appl. No.: 58,245

[22] Filed: Jul. 27, 1970

[51] Int. Cl. ..... B65h 39/06; B65h 29/28

[52] U.S. Cl. ..... 83/94; 29/786; 83/98; 83/171; 214/6 M; 270/58; 271/63

[58] Field of Search ..... 270/58; 83/94–96, 83/171, 402, 98, 99; 29/211 L; 156/511, 517, 559, 563, 299, 300, 303, 263; 264/152, DIG. 57; 93/93 R, 93 M, 93 D; 271/63, 86; 214/6 M

[56] References Cited

U.S. PATENT DOCUMENTS

| | | | |
|---|---|---|---|
| 1,444,595 | 2/1923 | Lateur | 214/6 M |
| 2,464,627 | 3/1949 | Weiss | 214/6 M |
| 3,135,150 | 6/1964 | Raynor | 83/94 |
| 3,483,065 | 12/1969 | O'Brien | 156/563 |
| 3,533,881 | 10/1970 | Beckman et al. | 29/211 L |

*Primary Examiner*—James M. Meister

[57] ABSTRACT

An apparatus for preparing layered, nonbonded, structures of cross-lapped film is disclosed wherein at least two rolls of layered, nonbonded film are combined by introducing into a common location cut portions of film from said rolls from at least two film delivery means. The film is delivered to the common location in alternating order. The layers in the structure are maintained in position in a suitable receptacle means.

8 Claims, 2 Drawing Figures

APPARATUS FOR PREPARING CROSS-LAPPED FILM STRUCTURES

This invention relates to laminated film materials. It more particularly relates to laminated materials comprised of oriented layers of polyolefin film. It specifically relates to an apparatus for positioning the layers of film in the laminate such that the directions of orientation differ from layer to layer.

At present a laminated structure prepared from crosslapped layers of oriented polyolefin film has found utility as an armor material. This laminated structure is comprised of a plurality of units of unidirectionally oriented polyolefin film or fibers which are stacked one on top of the other such that the lines of orientation of adjacent layers are at angles to each other. However, the method now used for stacking the layers to prepare the structure is inconvenient in that each layer is handled separately as it is positioned in the structure. There is at present no apparatus for the production of the crosslapped laminated structure directly from rolls of oriented film.

It is thus an object of this invention to provide an apparatus for preparing laminated structures of crosslapped layers of oriented film.

Other aspects, objects and the various advantages of this invention will become apparent to one skilled in the art from consideration of the following specification and claims.

In accordance with this invention there is provided an apparatus for combining at least two rolls of film to produce a nonbonded structure consisting of layers of crosslapped film. The rolls of film to be crosslapped are each placed in a delivery means. The delivery means are adjacent and at an angle to each other and cooperate one with the other such that the film contained in each means is progressively unrolled and transported to a cutting zone by suitable means, cut into desirable lengths for incorporation into the crosslapped structure, and then the cut lengths are delivered to a common location in alternating order to thus produce the desired crosslapped structure.

Figure 2:
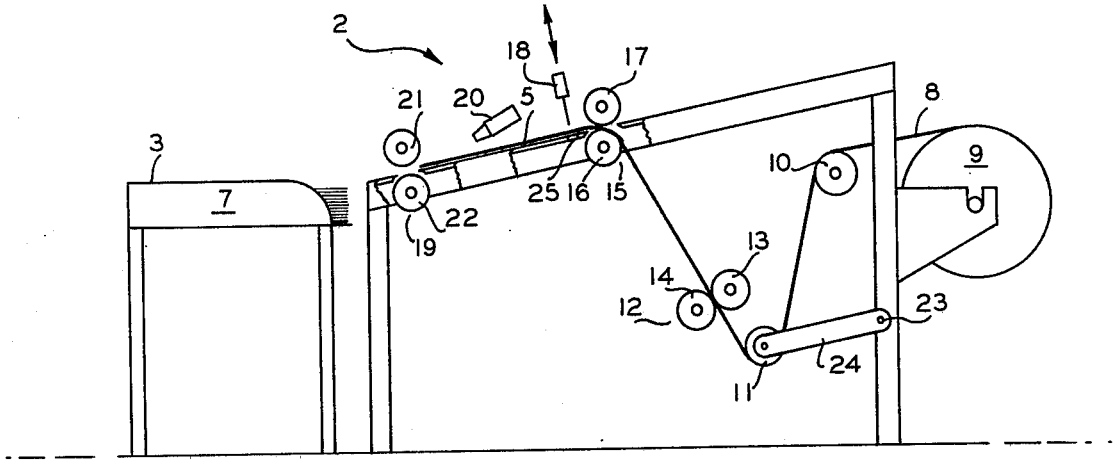
Figure 1:
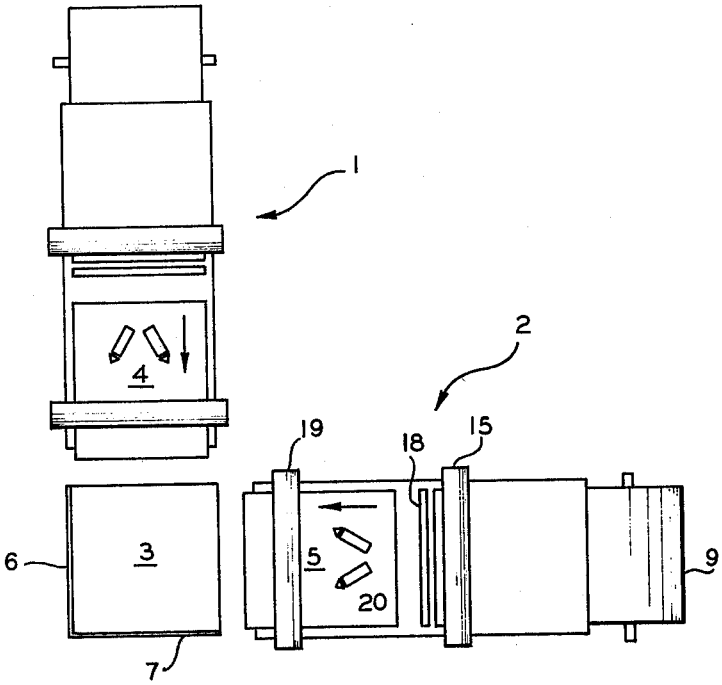

The apparatus of this invention is further and more particularly understood by referring to the description which follows and to FIGS. 1 and 2 which are a plan view and an elevation view, respectively, of the apparatus of this invention.

FIG. 1 specifically shows the overall configuration of the apparatus required to provide the crosslapping of the film material. FIG. 2 shows the relevant features of one of the at least two delivery means involved in the apparatus. As shall be further and more particularly pointed out with reference to FIG. 2, each delivery means, in process terms, is comprised of a storage-feed zone for rolls of film, a transportation zone for continually moving film from the feed zone to a cutting zone, a cutting zone for producing lengths of film desired to be deposited in a structure, and a second transportation zone for delivering cut lengths of film from the cutting zone to a common location for maintaining the cut film in crosslapped relationship.

Referring now to FIG. 1, delivery means 1 and delivery means 2 are shown to be adjacent and at an angle to each other. This configuration assists in the delivery of cut portions of film in alternating order to a common location such as receptacle 3. Thus, for example, cut film 4 is delivered to receptacle 3 from delivery means 1 followed by delivery to receptacle 3 of cut film 5 from delivery means 2. Delivery to receptacle means 3 in the above-described alternating order from delivery means 1 and 2 is continued until a desirable thickness of the resulting crosslapped film is established in receptacle 3. The film delivered to receptacle means 3 is maintained therein in stacked crosslapped relationship by means of raised side 6 opposite delivery means 2 and raised side 7 opposite delivery means 1. Thus, film from delivery means 1 such as film 4 enters receptacle 3 where it is stopped by raised side 7 and cut film from delivery means 2 such as film 5 enters receptacle 3 and is stopped against raised side 6.

In those situations where both film 4 and film 5 are unidirectionally oriented, wherein the direction of orientation of film 4 is parallel to the direction of movement of film 4 from delivery means 1 to receptacle 3 and wherein the direction of orientation of film 5 is parallel with the direction of movement of film 5 in delivery means 2 toward receptacle 3, then the resulting layered structure of film established in receptacle means 3 will comprise sheets of unidirectionally oriented film wherein the orientation directions of adjacent layers are at an angle one to another and further wherein the angle between adjacent film layers is equal to the angle between delivery means 1 and delivery means 2.

Referring now to FIG. 2, film 8 contained on film feed roll 9 passes from feed roll 9, over idler roll 10, around dancer roll 11, through transporting means 12 comprising powered counter-rotating rollers 13 and 14, to transporting means 15 comprising powered counter-rotating rollers 16 and 17, under cutting means 18 which severs film 8 on contact, thus producing cut film 5. Cut film 5, under the influence of a moving stream of gas directed toward the nip of transporting means 19 by nozzle 20, passes between powered counter-rotating rollers 21 and 22 of transporting means 19 and thence to receptacle 3.

As mentioned above, transporting means 12, 15, and 19 comprise powered counter-rotating rollers wherein transporting means 12 and 15 function to deliver film from film feed roll 9 to a location adjacent to cutting means 18 for severance. Film feed roll 9, idler roll 10, and dancer roll 11 are preferably not powered. They react to the pull exerted by transporting means 12 and 15. Idler 10 serves to guide film 8 from film feed roll 9 to dancer 11. Dancer 11 which is free to pivot around point 23 on radial bar 24 serves to maintain tension in film 8 especially during those times when transporting means 12 and 15 are not in operation. Because of the inertia of film feed roll 9, film 8 tends to continue to pass from film feed roll 9 even at those times when transporting means 12 and 15 are not in operation. Thus dancer 11 reacts to maintain tension in film 8 by moving around pivot point 23 on radial arm 24. Film feed roll 9 can also be fitted with braking means to aid in resisting its inertia at those times when transporting means 12 and 15 are not in operation.

In actual operation, transporting means 12 and 15 start and stop together and the peripheral speed of rollers 13 and 14 and 16 and 17 is substantially the same. Thus, film 8 is not subjected to tensile stresses between transporting means 12 and 15 on account of differing peripheral velocities of the rollers comprising transporting means 12 and 15. When a desired length of film has passed under cutting means 18 toward transporting means 19 by the action of transporting means 12 and 15, transporting means 12 and 15 are deenergized, thus ceasing rotation of rollers 13, 14, 16 and 17. Cutting means 18, acting in cooperation with transporting means 12 and 15, severs film 8 by contacting same at substantially the same time that transporting means 12 and 15 are deactivated and before the time when transporting means 12 and 15 are reenergized. Severed film 5 is then directed to transporting means 19 by gas such as air being emitted from jet 20, and passes between powered rollers 21 and 22 for delivery to receptacle 3. Transporting means 19 and jet 20 operate independently of transporting means 12 and 15 and cutting means 18; thus, transporting means 19 and jet 20 operate even when transporting means 12 and 15 are not energized.

In one aspect, film 8 is passing through transporting means 19 prior to being severed by cutting means 18. In this situation, the portion of film between transporting means 19 and transporting means 15 is under tension at the time of severance due to the fact that transporting means 15 is not in operation while transporting means 19 continues in operation.

In another aspect, film 8 is not passing through transporting means 19 at the time of severance by cutting means 18.

The spacing between transporting means 15 and 19 is a function of a number of variables, including the desired length of severed film and whether film 8 is to pass through transporting means 19 prior to being severed by cutting means 18.

In still another aspect of this invention, transporting means 12, 15 and 19 start and stop together and operate simultaneously at substantially the same peripheral velocity wherein film 8 is passing through transporting means 19 prior to severance at which time transporting means 12, 15 and 19 simultaneously cease operation followed by severing of film 8 with cutting means 18, after which time transporting means 12, 15 and 19 are actuated, thus delivering cut film 5 to receptacle 3 via transporting means 19 and preparing a subsequent length of film for cutting by moving same through transporting means 12 and 15 to transporting means 19. Under this aspect the film, whether in severed or nonsevered form, is under constant influence of one of transporting means 12, 15 and 19.

In a preferred embodiment, delivery means 1 and 2 are both in an inclined configuration as shown in FIG. 2. Furthermore, in the preferred embodiment, the portion of the inclined plane between transporting means 15 and 19 consists of a series of raised parallel ribs not shown which run perpendicular to transporting means 19 and 15. The film rides on the ribs, thus reducing the contact area between the surface of the film and the area between transporting means 15 and 19. By reducing the contact area as above described, the movement of film from transporting means 15 to transporting means 19 is enhanced and the influence of static electricity causing the film to adhere to the surface of the plane is reduced. Also in the preferred embodiment, cutting means 18 is a hot wire which descends to contact the film when transporting means 12 and 15 are deactivated or immediately thereafter. The hot wire is at appropriate temperature to sever the film upon contact therewith. In this embodiment, hot wire 18 upon severing film 8 does not contact the surface of the plane between transporting means 15 and 19 because a groove 25 constructed through and perpendicular to the above-mentioned ribbing is of sufficient depth and width to contain hot wire 18 in its fully descended severing position. Also, in the preferred embodiment, transporting means 12, 15 and 19 cooperate as previously described and film 8 is in contact with transporting means 19 prior to the time when cutting means 18 severs the film.

The above detailed description of the delivery means of this invention which includes reference numerals 8 through 25, inclusive, has been in specific reference to delivery means 2. However, the same description applies with equal facility to the various constituent parts and operation of delivery means 1. As previously indicated, there is but one difference between the operation of delivery means 1 and delivery means 2, which difference resides in the fact that cut film is delivered from delivery means 1 and delivery means 2 to receptacle means 3 in alternating order. Thus delivery means 1 and delivery means 2 cooperate in timed sequence to deliver cut film from one delivery means followed by the delivery of cut film from the second delivery means. This alternating sequence continues until such time that there is established in receptacle 3 a desired thickness of the thus crosslapped film.

This invention is particularly suitable for the production of a crosslapped structure of unidirectionally oriented film. Such a structure prepared with the apparatus of this invention from unidirectionally oriented film is comprised of individual layers wherein the direction of orientation of the film in each layer is different from the film in adjacent layers. Where the direction of motion of the film and the orientation direction of the film are parallel, the angular difference between the layers of film in the ultimate structure is equal to the angle between delivery means 1 and delivery means 2.

Where unidirectionally oriented film is crosslapped with the apparatus of this invention, it is preferred that the film materials be prepared from solid high molecular weight synthetic linear olefin polymer products or mixtures thereof formed by the polymerization of at least one monoolefin having from 2 to 8 carbon atoms therein which are capable of being formed into films which can be drawn (oriented) to a high percentage of elongation. While any means for orienting the material can be used, the material should be highly oriented, utilizing a draw ratio in the range of 6 to 1 to 20 to 1, preferably in the range of 9 to 1 to 14 to 1. Polyethylene, polypropylene, poly(1-butene), ethylene-1-1 butene copolymers, ethylene-propylene copolymers and the like, as well as blends or mixtures thereof, are polyolefins which can be used as materials of this structure.

Reasonable variations and modifications of this invention can be made or followed in view of the foregoing disclosure without departing from the spirit or scope thereof.

That which is claimed is:

1. An apparatus for crosslapping film comprising a first delivery means and a second delivery means, wherein said first delivery means and said second delivery means are adjacent and at an angle to each other and cooperate one with the other such that cut lengths of said film are delivered to a common location from said first delivery means and said second delivery means in alternating order, said first and said second delivery means each comprising, in combination, means for introducing a continuous sheet of said film into a first transporting means, said first transporting means comprising at least a first pair of powered counter-rotating rollers for passing said film therebetween to a cutting means, a cutting means for severing said film into said cut lengths, a second transporting means comprising at least a second pair of powered counter-rotating rollers for passing said cut lengths of film therebetween from said cutting means to said common location, and means for directing a moving stream of gas positioned between said cutting means and said second transporting means wherein said moving stream of gas is directed toward the nip of said second pair of rollers.

2. The apparatus of claim 1 wherein said cutting means is a hot wire which severs said film upon contact therewith.

3. The apparatus of claim 1 wherein said common location is a receptacle means in operable association with said first and said second delivery means, said receptacle means maintaining said film subsequent to delivery thereto in stacked crosslapped relationship.

4. The apparatus of claim 1 wherein said means for introducing said film into said first transporting means comprises in combination means for supplying said film to a third transporting means and a third transporting means comprising at least a third pair of powered counter-rotating rollers for passing said film therebetween to said first transporting means.

5. The apparatus of claim 4 wherein said first and said third transporting means start and stop together and operate simultaneously at substantially the same peripheral velocity.

6. The apparatus of claim 4 wherein said cutting means and said first and said third transporting means cooperate such that said cutting means is activated to sever said film when said first and said third transporting means cease rotation.

7. The apparatus of claim 4 wherein said means for supplying said film to said third transporting means comprises a film feed roll, an idler roll and a dancer roll.

8. The apparatus of claim 1 wherein said film is unidirectionally oriented olefin polymer film wherein the direction of orientation and direction of motion of said film within said delivery means are parallel.

* * * * *